United States Patent [19]

Sakai et al.

[11] Patent Number: 4,845,932

[45] Date of Patent: Jul. 11, 1989

[54] METHOD OF AND APPARATUS FOR SPINNING YARN

[75] Inventors: Shoji Sakai, Nagaokakyo; Shinichi Nishimura, Ohtsu, both of Japan

[73] Assignee: Murata Kikai Kabushiki Kaisha, Kyoto, Japan

[21] Appl. No.: 97,514

[22] Filed: Sep. 15, 1987

[30] Foreign Application Priority Data

Sep. 22, 1986 [JP] Japan ..... 61-224534

[51] Int. Cl.[4] ..... D01H 5/28; D02G 1/16

[52] U.S. Cl. ..... 57/5; 57/6; 57/224; 57/328

[58] Field of Search ..... 57/5, 6, 12, 328, 333, 57/334, 341–344, 909, 351, 224

[56] References Cited

U.S. PATENT DOCUMENTS

| | | | |
|---|---|---|---|
| 3,822,543 | 7/1974 | Edagawa et al. | 57/328 X |
| 3,978,648 | 9/1976 | Yamagata et al. | 57/328 X |
| 4,112,658 | 9/1978 | Morihashi | 57/328 |
| 4,114,358 | 9/1978 | Tsuchida et al. | 57/328 |
| 4,183,202 | 1/1980 | Morihashi | 57/328 |
| 4,497,167 | 2/1985 | Nakahara | 57/333 X |
| 4,713,931 | 12/1987 | Morrison et al. | 57/334 X |

*Primary Examiner*—Donald Watkins

*Attorney, Agent, or Firm*—Spensley Horn Jubas & Lubitz

[57] ABSTRACT

An air spinning method and apparatus for spinning a yarn. The apparatus includes a pipe with a fiber bundle passageway, air jet nozzles for applying whirling air currents near the inlet of the pipe, and a rotating body including air discharge passages and revolving around the pipe. In the method, the fiber bundle is passed through the pipe's fiber bundle passageway. Rear ends of some fibers are separated from the fiber bundle by air currents jetted from the nozzles so as to be rotated together with air currents by the rotating body after drawn into the discharge passage. Fibers lying in the central portion of the fiber bundle, pass through the pipe's fiber bundle passageway without being influenced by the air currents jetted from the nozzles. Fibers lying on the peripheral portion of the fiber bundle, however, are subjected to such air currents so that ends of some such fibers are separated from the fiber bundle, drawn into the air discharge passageway, whirled by the rotating body, and wound around other fibers of the fiber bundle. The spun yarn thus formed includes core fibers in substantially the same form and relationship to each other as in the fiber bundle, and winding fibers spirally wound around the core fibers along the length of the core fibers. The winding fibers are of uniform frequency and angle along the length of the core fibers.

41 Claims, 6 Drawing Sheets

METHOD OF AND APPARATUS FOR SPINNING YARN

BACKGROUND OF THE INVENTION

1. Field of the Invention

The present invention relates to a method and apparatus for spinning a yarn and, in particular, to a method and apparatus for manufacturing a spun yarn by twisting a twistless bundle of short fibers drafted by a drafting device.

2. Description of the Related Art

Conventional spinning frames may be roughly classified into three principal groups, namely, ring spinning, open-end spinning and air spinning. The recently developed air spinning frame is capable of spinning a yarn several times faster than the ring spinning frame.

An example of an air spinning frame is disclosed in the Japanese Patent Gazette, Laid-open No. Sho 53-45422 and its corresponding U.S. Pat. No. 4,112,658. In the apparatus disclosed in such patents, two jet nozzles are disposed subsequently to the drafting device and adapt compressed air currents whirling in the directions opposite to each other to act upon a fiber bundle issued from the drafting device. The fiber bundle is false-twisted by the second nozzles and then ballooned by the first nozzles. By this ballooning, some fibers are wound around other fibers and, when the fiber bundle is untwisted after passing through the second nozzles, wound more tightly, thereby a single line of yarn being spun.

There are certain problems with and deficiencies in the yarn spun by the above-described air spinning frame. For example, on close examination, it is found that the spun yarn is a fasciated yarn composed of a twistless or soft twisted core of fibers enveloped by other spirally running fibers. By changing spinning conditions, a ratio of the quantity of core fibers to the quantity of winding fibers, and the state of winding, can be more or less changed. As a result, the physical properties, such as the strength of the yarn, can be changed.

However, the air spinning frame of this kind is hardly capable of stabilizing the behavior of winding fibers and has only a limited capacity for improving yarn quality. Additionally, the energy costs for such a frame is relatively high as a result of the large consumption of compressed air by the two sets of air jet nozzles and some degree of insufficient spinning capability for relatively long staples such as wool fibers.

An object of the present invention is to provide a novel method and apparatus for yarn spinning which overcomes the above-mentioned problems of prior art air spinning frames.

SUMMARY OF THE INVENTION

The present invention includes a pipe having a passage through which a fiber bundle passes, air jet nozzles which create whirling air currents near the inlet of the pipe, and a rotating body having an air discharge passage and revolving around the pipe. The running fiber bundle, having issued from a pair of front rollers of the drafting device, is passed through the fiber bundle passage of the pipe. Rear ends of some fibers of the fiber bundle are separated from the fiber bundle by air currents jetted from the air jet nozzles, drawn into the air discharge passage of the rotating body, and rotated together with air currents by the rotating body.

Fibers lying in the central portion of the fiber bundle, having issued from a pair of front rollers, pass through the fiber bundle passage in the pipe without being influenced by the air currents jetted from the air jet nozzles. However, fibers lying on the peripheral portion of the fiber bundle are subjected to a force from the air currents jetted from the air jet nozzles which does act to separate fibers from the bundle of fibers. Ends of some fibers in the peripheral portion are thus exposed to air currents jetted from the air jet nozzles, separated from each other, drawn into the air discharge passage together with air currents, whirled by the rotating body, and wound around other fibers introduced into the fiber bundle passage.

BRIEF DESCRIPTION OF THE DRAWINGS

FIG. 4*b'* is a perspective view showing the same process as that shown in FIG. 4*b;*

DETAILED DESCRIPTION OF THE INVENTION

1. Spinning Frame Apparatus According to FIGS. 1–3 and 5.

Figure 5:
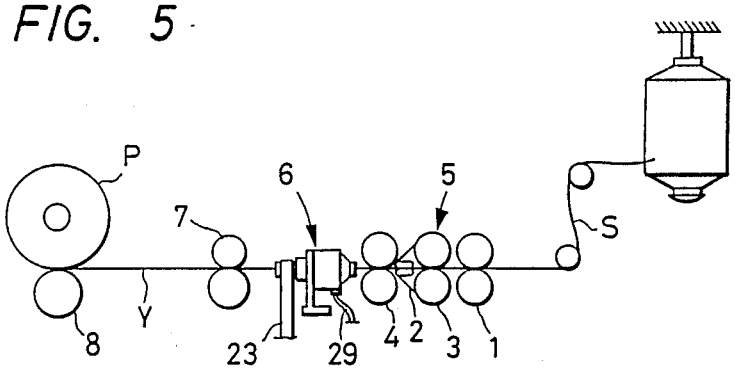
FIG. 5 is a schematic view of the whole spinning frame to which the present invention is applied.

FIG. 5 shows an apparatus for spinning a wool fiber yarn, in which a twistless worsted roving (that is, a fiber bundle (S)) wound around the bobbin, is: passed through a drafting device (5) comprising a pair of back rollers (1), a pair of middle rollers (3) with aprons (2), and a pair of front rollers (4); introduced into a spinning device (6) so as to be turned into a spun yarn (Y); drawn by a pair of delivery rollers (7); and wound into a package (P) rotated by a friction roller (8).

Figure 1:
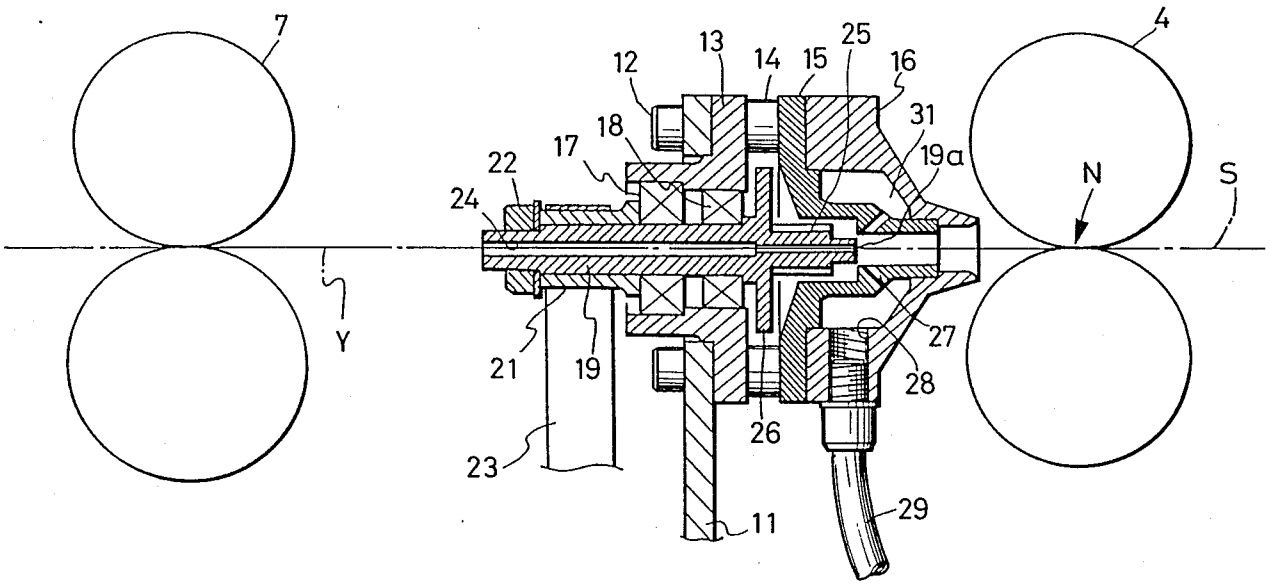
FIG. 1 is a vertical sectional view of a spinning apparatus according to the present invention.

A structure for the spinning device (6) in the spinning frame of FIG. 5 is shown in FIG. 1. Alternate long and short dash lines denote the path of the fiber bundle (S) or spun yarn (Y). A support plate (11) is fixed to the frame (not shown). A hollow cylindrical flange (13) is fixed to the support plate (11) with a plurality of screws (12). A hollow disk-like nozzle body (15) is fixed to the flange (13) with the screws (12) through a spacer (14). A hollow cap (16) is fixed to the nozzle body (15). A revolving pipe (19) is rotatably supported by bearings (17) and (18) fitted into the inner part of the flange (13). A hollow pulley (21) is securely fitted onto the pipe (19) so as to be interposed between a nut (22) meshing with the end of the pipe (19) and the inner ring of the bearing (17) as if pressed from both sides. A driving belt (23) is applied onto the pulley (21) and driven by a motor (not shown) so as to drive the pulley (21) and the revolving pipe (19) at high speed.

A fiber bundle passage (24) is pierced through the center of the revolving pipe (19). A spinning device (6)

of the present invention is disposed along a straight line on which the centers of this passage (24), the hollow parts of the nozzle body (15) and the cap (16) are in agreement with the path of the fiber bundle (S). The distance between the inlet port (19*a*) of the pipe and the nip point (N) is set to be shorter than the mean staple length of fibers composing the fiber bundle (S).

Figure 2:
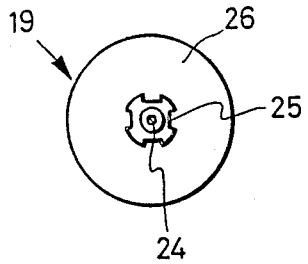
FIG. 2 is a front view of a revolving pipe.

The fiber bundle passage (24) is about 1.8 mm in inner diameter of the revolving pipe (19) at the inlet part (that is, the right side in the drawing in FIG. 1), and about 3.0 mm at the remaining or subsequent part. The inner diameters of hollow parts of the nozzle body (15) and the cap (16) are set amply large. The outer diameter of the revolving pipe (19) is sufficiently small at the inlet part and comparatively large at the other subsequent part. The outer periphery of the subsequent part is provided with four grooves (25) as shown in FIG. 2, each being parallel to the fiber bundle passage (24).

Further, the revolving pipe (19) is provided with a disk (26) disposed between the part having grooves (25) and the bearing (18). The disk (26) is positioned between the flange (13) and the nozzle body (15). The disk (26) has a diameter small enough not to touch the spacer (14), but large enough to cover the bearing (18).

Figure 3:
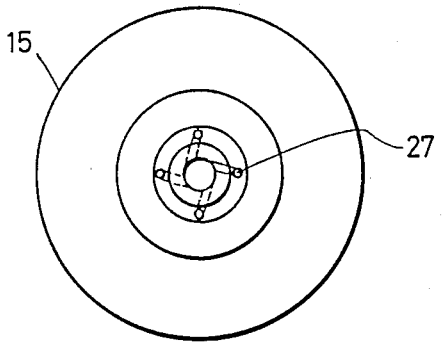
FIG. 3 is a front view of a nozzle body.

The nozzle body (15) is internally stepped to have different diameters at the hollow part so as to cover the inlet part of the revolving pipe (19). As shown in FIG. 3, the nozzle body (15) is provided with four jetting parts, namely, air jet nozzles (27). Such air jet nozzles (27) are directed toward the inlet (19*a*) of the revolving pipe (19) and tangentially with respect to the hollow part.

An air hose (29) connected at one end to a source of compressed air (not shown) is fitted into a hole (28) provided on a part of the cap (16). Compressed air fed from the hose (29): flows into an air chamber (31) formed between the nozzle body (15) and the cap (16); jets out from the air jet nozzles (27) to the hollow part of the nozzle body (15); and creates whirling air currents in the vicinity of the inlet (19*a*) of the revolving pipe (19). Air currents thus created pass through a gap between the revolving pipe (19) and the nozzle body (15), through grooves (25) as an air discharge passage, to be guided to the disk (26) and are discharged outside the device through both sides of each of spacers (14). At the same time, the air currents generate a suction air stream to flow from a nip point (N) of a pair of front rollers (4) to the hollow part of the nozzle body (15).

2. Spinning Process According To FIGS. 4*a*–4*d*

A process to spin a yarn using a spinning apparatus according to the present invention referred to above, will now be described with reference to FIGS. 4*a* through 4*d*. These drawings depict only the front rollers (4), nozzles body (15) and revolving pipe (19). A continuous line ($f_1$) indicates a single fiber composed of a fiber bundle (S) or a yarn (Y) shown by the alternate long and short dash line, and lying in the outer peripheral portion of the fiber bundle (S).

Figure 4A:
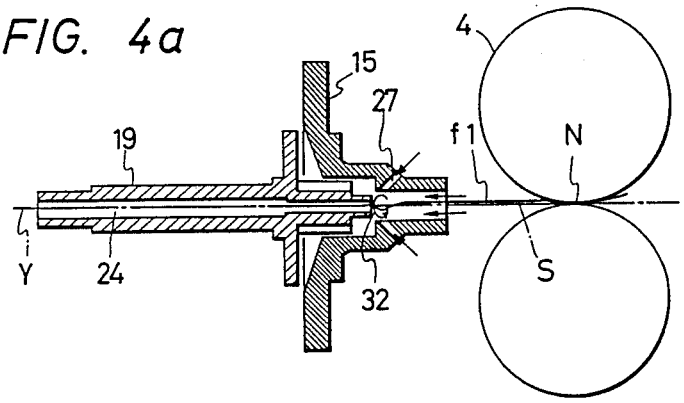
FIGS. 4*a* through 4*d* are views illustrating processes to spin a yarn according to the present invention.

In FIG. 4*a*, the fiber bundle (S) drafted by the drafting device (5) and delivered by the front rollers (4) is drawn into the spinning device (6) by suction air acting on the inner space in the hollow part of the nozzle body (15), and pulled outside by the delivery rollers (7) after being passed through the fiber bundle passage (24) of the revolving pipe (19). In the course of this process, the fiber bundle (S) is subjected to action of compressed air jetted from the air jet nozzles (27) in the vicinity of the inlet of the revolving pipe (19) and whirling in the direction shown by the arrow (32) so as to be false-twisted to a slight degree in such direction.

Fibers lying in the central portion of the fiber bundle (S) are not directly exposed to the air currents and untwisted to the initial state immediately after passing the pipe inlet (19*a*). On the other hand, fibers ($f_1$) lying on the periphery of or in portions near the periphery of the fiber bundle (S) are directly exposed to the air currents and subjected to force acting to separate these fibers from the bundle (S). However, the front ends of fibers in the bundle (S), when lying in the position of the revolving pipe inlet (19*a*), are subjected to false-twisting and, therefore, difficult to separate from the bundle. The rear ends are nipped by the front rollers (4) or lie distant from the nozzles (27), thereby being less influenced by air currents and not separated from the bundle.

Figure 4B:
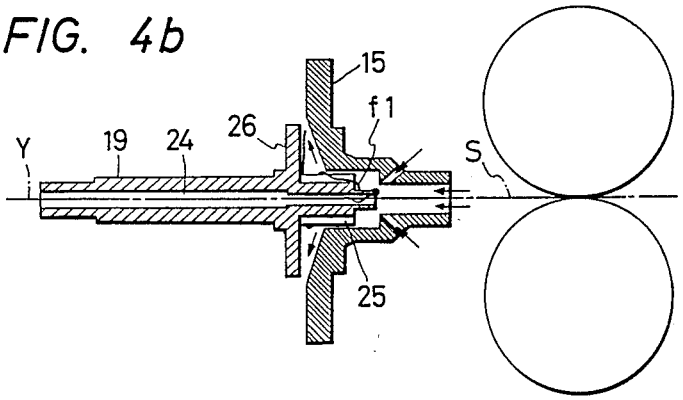
Figure 4B:
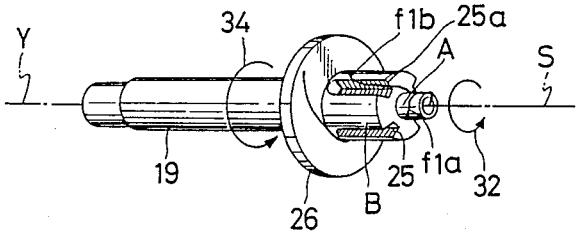

In FIG. 4*b*, the rear end of the fiber ($f_1$), when detached from a pair of front rollers (4) and approaching the air jet nozzles (27), is subjected to a strong force of air current jetted from the nozzles (27) and is separated from the fiber bundle (S). At this time, the front ends of the fibers ($f_1$) are partially false-twisted and inserted into the revolving pipe (19). The front ends of the fibers are less influenced by air currents, and therefore are not separated from the fiber bundle. The rear ends of the fibers, on the other hand, which almost do not undergo any false-twisting action, are separated from the fiber bundle. The separated rear ends of fibers, after being wound once or more around the inlet part of the revolving pipe (19) by the action of air currents as shown in FIG. 4*b*′, pass through the grooves (25), are slightly wound around the outer periphery of the pipe after issuing from the grooves (25), and outwardly extend while guided by the disk (26).

The diametrically small inlet of the revolving pipe (19) is designated as a small diameter part (A), and the diametrically large inlet with grooves (25) is designated as a large diameter part (B). A fiber winding around the small diameter part (A) is designated as ($f_{1a}$), and another fiber around the large diameter part (B) is designated as ($f_{1b}$). The fiber ($f_{1a}$) is wound around the small diameter part (A) by the whirling air current (32) jetted from the air jet nozzles (27) and in the same direction as that of the air current (32). The other fiber ($f_{1b}$), while partly being caught by the shoulder part (25*a*) of the grooves (25), is wound around the large diameter part (B) in the direction as shown with the rotation of the revolving pipe (19).

Figure 4C:
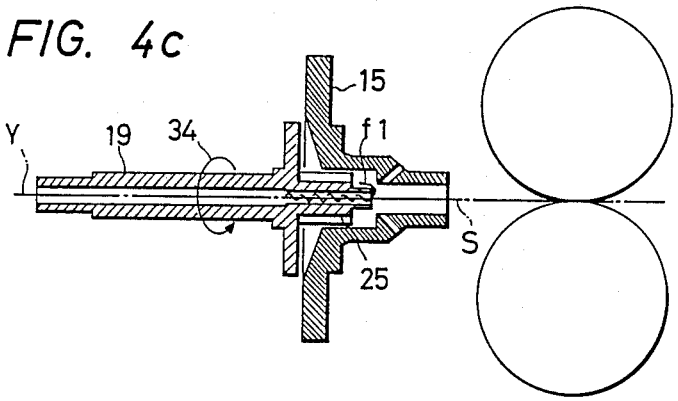
Figure 4D:
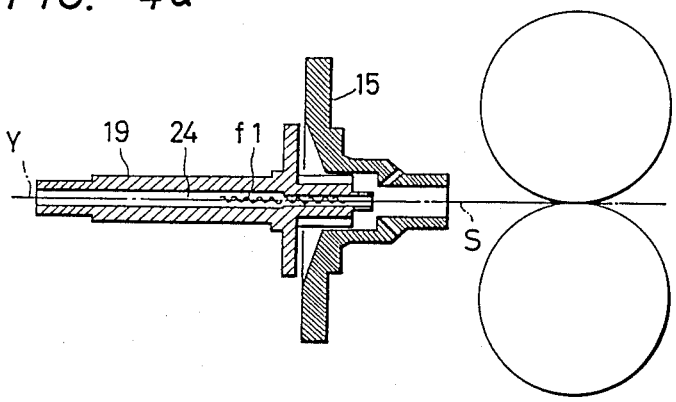

In FIG. 4*c*, the fiber bundle (S) runs leftward and the revolving pipe (19) revolves in the direction of the arrow (34) so that the rear ends of fibers ($f_1$) are gradually drawn out from the grooves (25) while whirled around the fiber bundle (S). As a result, the fibers ($f_1$) are spirally wound around the fiber bundle (S) as shown in FIG. 4*d*, whereby the fiber bundle (S) turns into a yarn (Y) and passes through the fiber bundle passage (24).

In the course of the above-described process to spin a yarn (Y), fibers ($f_1$) are separated from the periphery of the fiber bundle (S) throughout and consequently cause other internally lying fibers to be exposed to air current, whereby a large number of fibers are continuously separated from the fiber bundle (S). The fibers thus separated are drawn into the grooves (25) at even distribution and then uniformly wound around the peripheries of fibers composing the core of the fiber bundle. A winding direction of fibers ($f_1$) is dependent on the rotational direction of the revolving pipe (19). That is to say, the arrowed rotational direction (34) and the reverse one of the pipe (19) provide winding of fibers in Z-twist and S-twist directions, respectively. A direction of air current by air jet nozzles (27) is preferably set to be the same as the rotational direction of the revolving pipe (19) for preventing disturbance in the winding direction of fibers ($f_1$) and separation of the front ends of fibers from the bundle by whirling of the rear ends of fibers.

When a rotational direction of the revolving pipe (19) and a whirling direction of air current are set to be the same with each other as shown in FIG. 4*b'*, the number of coils (that is, the number of twists of a spun yarn (Y)) is produced as the total sum of the number of twists produced by revolutions of the revolving pipe (19) and the number of twists obtained when the fiber ($f_1$) is wound around the small diameter part (A). A ratio between the former number of twists and the latter one is dependent on the revolving speed of the pipe (19) and the pressure of jetted air. However, influence of the revolving speed of the pipe (19) thereupon is significant and the number of twists imparted by revolutions of the pipe (19) is larger than those produced by the other factors. In this way, since the number of twists of a yarn (Y) is larger than that obtained from revolutions of the revolving pipe (19), even a small consumption of energy can provide a larqe number of twists and sufficient strength for the yarn (Y).

3. Resulting Spun Yarn According To FIG. 6

Figure 6:
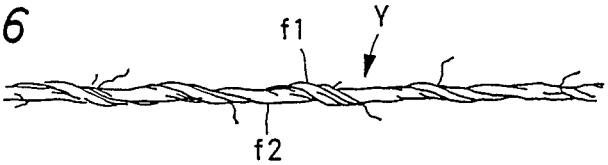
FIG. 6 is a view of an appearance of a yarn spun according to the present invention.

FIG. 6 shows an appearance of the yarn (Y) spun by the above-described process. This spun yarn is characterized by basic structure in which winding fibers ($f_1$) are coiled around core fibers ($f_2$) and both kinds of fibers ($f_1$) and ($f_2$) are arranged to be less disturbed. The number of winding fibers ($f_1$) along the length of the yarn (Y) and degrees of winding angle of fibers are uniform, whereby the yarn is even in thickness and less fluffy or of less fluffy loops. On a yarn (Y) spun and wound along a path directed from right to left as shown in FIG. 6, the number of fluffs projecting from the yarn toward the right side is larger than that of others, the ratio therebetween being about 10 to 1.

Such features of the yarn are attributable to the spinning process as illustrated in FIGS. 4*a* through 4*d*. In other words, the yarn owes its features to the fact that winding fibers ($f_1$) wind around core fibers ($f_2$) not randomly but mechanically in such manner that winding fibers ($f_1$) are separated from the bundle at rear ends and whirled with revolutions of the grooves (25) retaining the rear ends of winding fibers ($f_1$) so as to wind around core fibers ($f_2$), thereby providing directional properties, regularity, and stability for the behavior of winding fibers ($f_1$).

In the spinning process of yarn (Y) using an apparatus of the present invention, it is presumable that the front end of the fiber lying on the periphery of the fiber bundle (S) may possibly be separated therefrom and wound therearound. But, as far as known from observing the yarn (Y) spun by this apparatus, it appears that the number of fibers wound in the above-described manner is comparatively small; most fibers have been wound as a result of separation of rear ends thereof from the fiber bundle as described above with reference to FIGS. 4*a* through 4*d*.

A description of the process in which the front end of a fiber is separated from the bundle (S) and wound therearound is such that, when the air current jetted from the nozzles (27) acts upon such a fiber as having the front end laid on the surface of the fiber bundle (S) and, therefore, easily separable as well as the rear end laid in the core part of the bundle (S) and hardly separable, the front end part is separated from the bundle before reaching the pipe inlet (19*a*) and drawn into the groove (25) while being wound around the revolving pipe (19). At this time, the rear end is not separated from the bundle (S) and is retained therewithin, whereby the fiber is spirally wound around the fiber bundle with running of the fiber bundle (S) and revolutions of the revolving pipe. The number of coils of the fiber and winding angle thereof are the same as those obtained when the rear end of the fiber is subjected to separation.

4. Strength Of The Yarn According To FIG. 7

Figure 7:
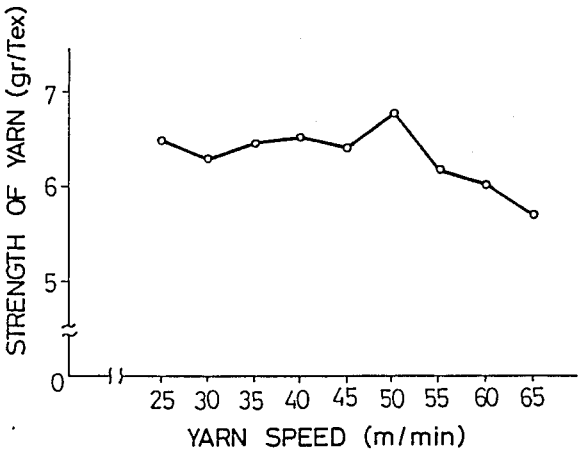
FIG. 7 is a graph showing the relation between the spinning speed and strength of the yarn spun according to the present invention.

FIG. 7 is a graph showing the strength of a yarn obtained according to the present invention and as shown in FIG. 6. The yarn spun of 100% wool fibers and as thick as 27 NM was measured with respect to the strength corresponding to yarn speed on conditions that the pressure of air current jetted from the nozzles (27) is 3 kg/cm$^2$ and the RPM of the revolving pipe (19) is 16,000. When the yarn speed was below 35 m/min, RPM of the pipe was set slightly lower than 16,000.

From this graph, it can be understood that the yarn spun according to the present invention possesses a strength comparable to that of the yarn spun by the ring spinning frame. A production efficiency of the ring spinning frame in spinning of the yarn of 100% wool fibers is generally at the level of 15 to 20 m/min and it will be understood that the yarn according to the present invention can be spun at a speed two or three times higher than that for the ring spinning frame. Further, the numbers of Thin, Thick, and Nep counted by the Uster tester were 55, 8, and 4, respectively, per 500 m of this yarn at a yarn speed of 50 m/min, U % being 13.01. The numbers of fluffs in lengths of 2, 3, and 4 mm or more per 200 m of the yarn were 32, 5, and 2, respectively.

These results prove that the yarn according to the present invention is superior in quality because of less imperfections and fluffs. The quality of this yarn can be improved by modification of the mechanism of the spinning device and changes to the spinning conditions. The present invention is applicable to the fiber bundle (S) which is a twistless sliver doffed from the drawing frame or to spinning of polyester/cotton blended yarn and yarns of various kinds of fibers in addition to that of wool fiber yarn, and permits speeding-up of spinning operation according to the condition in each of the above processes.

Figure 8:
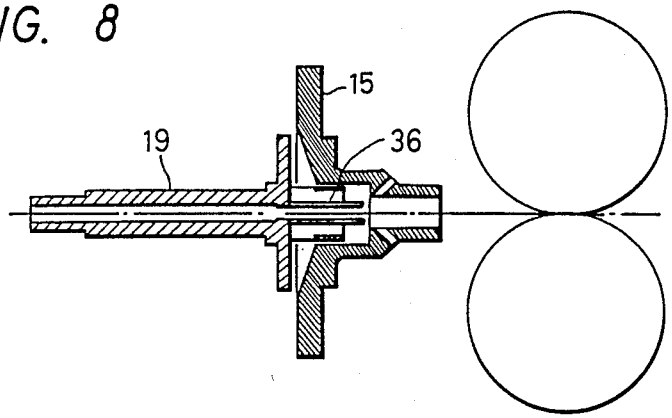
FIGS. 8 through 10 are views of other embodiments of the spinning apparatus of the present invention.
Figure 9:
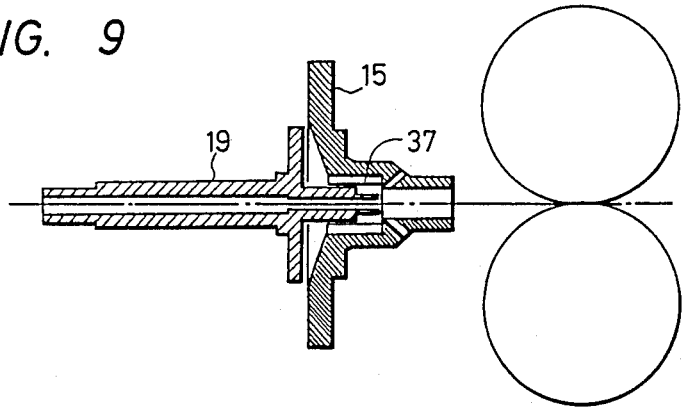

5. Other Embodiments According To FIGS. 8–10

Figure 10:
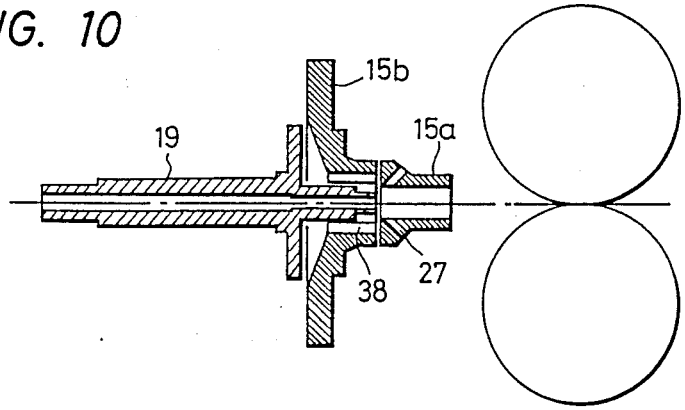

The present invention is not limited to the embodiments described above and can be applied to various kinds of devices of modified design. For example, the air current discharge passage is in the form of a groove (25) in the embodiment of FIG. 1, but is a hole (36) in the embodiment of FIG. 8. In the embodiment shown in FIG. 9, grooves (37) as air discharge passages are formed on the inner periphery of the nozzle body (15), in which an effect to whirl rear ends of fibers separated from the fiber bundle can be exhibited with the pipe (19) set unmovable and nozzle body (15) rotatable. The embodiment shown in FIG. 10 is provided with grooves (38) as air discharge passages formed on the inner periphery of the hollow part of the nozzle body (15), wherein the nozzle body (15) is divided into a part (15*a*) having air jet nozzles (27) and the other part (15*b*) having the grooves (38) so that rear ends of separated fibers may be whirled by setting the former part (15*a*) and the pipe (19) unmovable and only the latter part (15*b*) rotatable. That is to say, a pipe for passage of the fiber bundle and a revolving body for whirling rear ends of separated fibers are united into one body as a revolving pipe (19) in the embodiment shown in FIG. 1, however, may be independent from each other as in the embodiments shown in FIGS. 9 and 10, the roughly same action being obtainable.

6. Effects of the Invention

As has hitherto been described, the present invention provides an entirely novel method and apparatus for the spinning of a yarn which are capable of producing a yarn of superior quality rarely having imperfections as fluffs or uneven thickness, and successfully enables high speed spinning for such fibers as difficult to spin by the conventional air spinning frame.

What is claimed is:

1. A method of spinning a yarn characterized in that rear ends of some of fibers collected into a running bundle are separated from said bundle by means of air currents and adapted to wind around the periphery of said bundle by whirling force applied thereto, whereby a spinning yarn comprising a plurality of core fibers and a plurality of wrapped fibers is produced, the wrapped fibers being wrapped spirally around the core fibers, the winding angle, the winding direction and the amount of winding of the wrapped fibers of the resulting spun yarn being substantially uniform along the longitudinal direction of the yarn.

2. An apparatus for spinning a yarn comprising: a pipe having a fiber bundle passage through which a bundle of fibers issuing from a pair of front rollers of the drafting device passes, air jet nozzles adapting whirling air currents to act upon the fiber bundle at a point near the inlet of said pipe for separating fiber ends from said fiber bundle, and a rotating body provided with a discharge passage for said air currents and rotating, together with said fiber ends drawn into said discharge passage, around said pipe.

3. An apparatus for spinning a yarn as set forth in claim 2, wherein the whirling direction of air currents jetted from said air jet nozzles is set to be the same as the rotating direction of said rotating body.

4. An apparatus for spinning a yarn as set forth in claims 2 or 3, wherein said pipe and rotating body are integral with each other.

5. An apparatus for spinning a yarn as set forth in claim 2, wherein a diametrically small part of said pipe around which fiber ends separated by whirling air currents from said air jet nozzles wind is provided between the inlet of fiber bundle passage of said pipe and the discharge passage of said rotation body.

6. An apparatus for spinning a spun yarn from a fiber bundle comprising:

(a) a tube having an inlet port, an outlet port, a fiber bundle passageway defined between the inlet and outlet ports through which a fiber bundle is passed;

(b) a fluid means for generating a whirling current of compressed fluid near the inlet of the tube, such that fiber ends on the periphery of the fiber bundle are subjected to compressed fluid and separated from the fiber bundle; and (c) a whirling force means for applying a whirling force to the separated fiber ends, such that such separated fiber ends are wound spirally around the fiber bundle.

7. The apparatus of claim 6 wherein the whirling force means is a rotating member which is rotatable around the tube near the inlet port.

8. The apparatus of claims 6 or 7 wherein the rotating member is an integral part of he tube.

9. The apparatus of claims 6 or 7 wherein the tube is substantially cylindrical.

10. The apparatus of claim 7 wherein the rotating member is substantially cylindrical.

11. The apparatus of claims 6 or 7 wherein the fluid is air.

12. An apparatus for spinning yarn from a fiber bundle comprising:

(a) a first member having an inlet part, an outlet part and a fiber bundle passageway defined between the inlet and outlet parts through which a fiber bundle is passed;

(b) a plurality of nozzles directing a current of compressed fluid in a whirling direction towards the inlet part of the first member, such that as the fiber bundle approaches the inlet part of the first member, fiber ends on the periphery of the fiber bundle are subjected to compressed fluid and separated from the fiber bundle;

(c) a rotatable member located about said inlet part;

(d) a plurality of discharge passageways coupled to said nozzles and substantially coaxial with respect to the fiber bundle passageway so that the compressed fluid from the nozzles is discharged via said passageway, such that the separated fiber ends are wound around the inlet part and then drawn into the discharge passageways; and (e) wherein the rotatable member is rotatable about an axis aligned with the inlet part, and the separated fiber ends in the discharge passageways wind spirally around the fiber bundle.

13. The apparatus of claim 12 wherein the rotatable member is an integral part of the first member.

14. An apparatus for spinning a spun yarn from a fiber bundle comprising:

(a) a tube having an inlet part including an inlet port, an outlet part including an outlet port, and a fiber bundle passageway defined between the inlet and outlet ports through which a fiber bundle is passed;

(b) a plurality of nozzles directing a current of compressed fluid in a whirling direction towards the inlet port of the tube, such that as the fiber bundle approaches the inlet port of the tube, fiber ends on the periphery of the fiber bundle are subjected to compressed fluid and separated from the fiber bundle;

(c) wherein the inlet part of the tube further includes a plurality of discharge passageways substantially parallel to the fiber bundle passageway through which compressed fluid from the nozzles is discharged, such that the separated fiber ends are wound around the inlet part of the tube and then drawn into the discharge passageways; and (d) wherein the tube is rotatable, such that the separated fiber ends in the discharge passageways pass through the grooves and then wind spirally around the fiber bundle.

15. The apparatus of claim 14 wherein the tube is substantially cylindrical.

16. The apparatus of claims 12 or 13 wherein the rotatable member is substantially cylindrical.

17. The apparatus of claims 12 or 13 or 14 wherein the fluid is air.

18. The apparatus of claims 12 or 13 wherein the direction of the whirling current of fluid from the nozzles and the direction of rotation of the rotatable member are the same.

19. The apparatus of claim 14 wherein the direction of the whirling current of fluid from the nozzles and the direction of rotation of the tube are the same.

20. The apparatus of claims 12 or 13 or 14 wherein the discharge passageways are grooves.

21. The apparatus of claims 12 or 13 or 14 wherein the discharge passageways are holes.

22. The apparatus of claims 12 or 13 or 14 wherein the inlet part has a diameter less than the diameter of the outlet part.

23. The apparatus of claims 12 or 13 or 14 wherein the part of the fiber bundle passageway parallel to the inlet part has an inlet diameter less than the outlet diameter of the part of the fiber bundle passageway parallel to the outlet part.

24. The apparatus of claim 23 wherein the inlet diameter is approximately 60 percent of the outlet diameter.

25. An apparatus for spinning a spun yarn from a fiber bundle comprising:

(a) a substantially hollow cylindrical shell;

(b) a pipe supported within the shell and defining a fluid chamber between the pipe and the shell, said pipe having: (i) an inlet port at a first end; (ii) an outlet port at a second end; and (iii) a fiber bundle passageway between the inlet and outlet ports through which a fiber bundle is passed;

(c) a plurality of nozzles: (i) formed within the shell; (ii) communicating at one end with the fluid chamber; and (iii) directed at the other end toward the inlet port of the pipe;

(d) a compressed fluid supply means directing compressed fluid into the fluid chamber, through the nozzles and toward the inlet port of the pipe, such that whirling currents of fluid act upon the fiber bundle at a point near the inlet port to separate fiber ends from the fiber bundle;

(e) a rotating member located around a part of the pipe near the inlet port, having a plurality of discharge passages substantially parallel to the fiber bundle passage through which the compressed fluid is discharged, such that the separated fiber ends are drawn into the discharge passages; and (f) wherein the rotating member is rotatable around a part of the pipe near the inlet port, such that the separated fiber ends are wound spirally around the fiber bundle.

26. The apparatus of claim 25 wherein the shell comprises, from a first side to a second side:

(a) a flange;

(b) a nozzle body fixed to the flange; and (c) a cap fixed to the nozzle body, the fluid chamber being defined between the cap and the nozzle body.

27. The apparatus of claims 25 or 26 wherein the rotating member is an integral part of the pipe.

28. The apparatus of claims 25 or 26 further comprising:

(a) a drafting device for providing the fiber bundle to the fiber bundle passageway, said drafting device including a pair of rollers which nip the fiber bundle at a nip point; and (b) wherein the distance between the nip point and the inlet port of the pipe is less than the mean staple length of the fibers comprising the fiber bundle.

29. The apparatus of claims 25 or 26 wherein the fiber bundle passage near the inlet port of the pipe has an inlet diameter, the remaining part of the fiber bundle passage has an outlet diameter, and the inlet diameter is less than the outlet diameter.

30. The apparatus of claim 29 wherein the inlet diameter is approximately 60 percent of the outlet diameter.

31. The apparatus of claim 26 wherein the pipe further includes a disk between the inlet port and the outlet port, and disposed between the flange and the nozzle body.

32. A method of spinning a spun yarn from a fiber bundle comprising the steps of:

(a) separating from a fiber bundle, an end of fibers near the periphery of the fiber bundle; and (b) subjecting the separated end of fibers to a whirling force, such that the separated end of fibers are wound around the fiber bundle, whereby a spinning yarn comprising a plurality of core fibers and a plurality of wrapped fibers is produced, the wrapped fibers being wrapped spirally around the core fibers, the winding angle, the winding direction and the amount of winding of the wrapped fibers of the resulting spun yarn being substantially uniform along the longitudinal direction of the yarn.

33. The method of claim 32 wherein step (a) comprises the step of subjecting a first end of fibers near the periphery of the fiber bundle to a stream of whirling compressed fluid.

34. A method of spinning a spun yarn from a fiber bundle comprising the steps of:

(a) subjecting a first end of fibers near the periphery of the fiber bundle to a stream of whirling compressed fluid, such that a first end of fibers near the periphery of the fiber bundle are separated from the fiber bundle; and (b) applying a whirling force to the separated first end of the fibers, such that such fibers are spirally wound around other unseparated fibers closer to the center of the fiber bundle than the separated fibers, whereby a spinning yarn comprising a plurality of core fibers and a plurality of wrapped fibers is produced, the wrapped fibers being wrapped spirally around the core fibers, the winding angle, the winding direction and the amount of winding of the wrapped fibers of the resulting spun yarn being substantially uniform along the longitudinal direction of the yarn.

35. A method of spinning a spun yarn from a fiber bundle comprising the steps of:

(a) directing a whirling stream of compressed fluid at the fiber bundle, such that the fiber bundle is false-twisted to a slight degree in the same direction as the whirling direction of compressed fluid;

(b) continuing to direct a whirling stream of compressed fluid at the fiber bundle, such that one end of fibers in close proximity to the periphery of the fiber bundle are separated from the bundle; and (c) subjecting the separated end of fibers are wound around the fiber bundle, whereby a spinning yarn comprising a plurality of core fibers and a plurality of wrapped fibers is produced, the wrapped fibers being wrapped spirally around the core fibers, the winding angle, the winding direction and the amount of winding of the wrapped fibers of the resulting spun yarn being substantially uniform along the longitudinal direction of the yarn.

36. A method of spinning a spun yarn from a fiber bundle comprising the steps of:

(a) subjecting a fiber bundle to a circular flow of compressed fluid, such that the fiber bundle is false-twisted slightly in the same direction as the circular flow of fluid;

(b) directing jets of compressed fluid at one end of fibers near the periphery of the fiber bundle, such that ends such fiber ends are separated from the fiber bundle; and (c) applying to the separated fiber ends a whirling force, such that such fiber ends are coiled around the exterior of the fiber bundle, whereby a spinning yarn comprising a plurality of core fibers and a plurality of wrapped fibers is produced, the wrapped fibers being wrapped spirally around the core fibers, the winding angle, the winding direction and the amount of winding of the wrapped fibers of the resulting spun yarn being substantially uniform along the longitudinal direction of the yarn.

37. The method of claims 33 or 34 or 35 or 36 wherein the direction of the compressed fluid is the same as the direction of the whirling force.

38. The method of claims 33 or 34 or 35 or 36 wherein the fluid is air.

39. The method of claims 32 or 33 or 34 or 35 or wherein the whirling force is generated by rotating a member around the fiber bundle.

40. An apparatus for spinning a yarn as set forth in claim 3, wherein a diametrically small part of said pipe around which fiber ends separated by whirling air currents from said air jet nozzles wind is provided between the inlet of fiber bundle passage of said pipe and the discharge passage of said rotating body.

41. An apparatus for spinning a yarn as set forth in claim 4, wherein a diametrically small part of said pipe around which fiber ends separated by whirling air currents from said air jet nozzles wind is provided between the inlet of fiber bundle passage of said pipe and the discharge passage of said rotating body.

* * * * *